US010029885B2

(12) United States Patent
D'Apice et al.

(10) Patent No.: US 10,029,885 B2
(45) Date of Patent: Jul. 24, 2018

(54) ELEVATOR

(71) Applicant: Inventio AG, Hergiswil (CH)

(72) Inventors: Alessandro D'Apice, Ebikon (CH); Adrian Steiner, Inwil (CH); Marcel Nicole, Stansstad (CH)

(73) Assignee: INVENTIO AG, Hergiswil NW (CH)

( * ) Notice: Subject to any disclaimer, the term of this patent is extended or adjusted under 35 U.S.C. 154(b) by 0 days.

(21) Appl. No.: 15/541,768

(22) PCT Filed: Jan. 11, 2016

(86) PCT No.: PCT/EP2016/050345
§ 371 (c)(1),
(2) Date: Jul. 6, 2017

(87) PCT Pub. No.: WO2016/116312
PCT Pub. Date: Jul. 28, 2016

(65) Prior Publication Data

US 2017/0355561 A1 Dec. 14, 2017

(30) Foreign Application Priority Data

Jan. 20, 2015 (EP) ..... 15151858

(51) Int. Cl.
*B66B 5/00* (2006.01)

(52) U.S. Cl.
CPC ..... *B66B 5/0081* (2013.01)

(58) Field of Classification Search
CPC ..... B66B 5/0081; E04G 2007/285
See application file for complete search history.

(56) References Cited

U.S. PATENT DOCUMENTS 2,753,224 A * 7/1956 Troche ..... B66F 11/04 182/113
3,844,520 A * 10/1974 Werner ..... E04G 5/14 248/228.3
3,851,858 A * 12/1974 Komiske ..... E04F 11/1812 256/59
3,853,203 A * 12/1974 Werner ..... E04G 5/14 182/113
4,126,210 A * 11/1978 Martin ..... B66B 11/0233 187/401
6,406,002 B1 * 6/2002 Hardy, III ..... E01F 13/022 256/23
6,543,584 B1 * 4/2003 Miyakoshi ..... B66B 5/0081 182/113
8,365,870 B2 * 2/2013 Sirigu ..... B66B 5/0068 187/306
9,051,746 B2 * 6/2015 Rogers ..... E04G 7/28
2002/0170783 A1 * 11/2002 Goode ..... A62B 1/22 187/240

(Continued)

FOREIGN PATENT DOCUMENTS

FR 2891820 A1 * 4/2007 ..... B66B 5/0081
WO 2013053606 A1 4/2013

*Primary Examiner* — Michael A Riegelman
(74) *Attorney, Agent, or Firm* — William J Clemens; Shumaker, Loop & Kendrick, LLP

(57) ABSTRACT

An elevator having a car with a car roof includes a barrier on the roof for anti-fall safety purposes. The barrier has a toeboard, and at least some of the cables for the cabin electrical system are routed within the toeboard.

10 Claims, 3 Drawing Sheets

(56) References Cited

U.S. PATENT DOCUMENTS

| | | | | |
|---|---|---|---|---|
| 2005/0252726 | A1* | 11/2005 | Det | B66B 5/0081 187/401 |
| 2007/0056810 | A1* | 3/2007 | Fernandes | B66B 5/00 187/401 |
| 2008/0217113 | A1* | 9/2008 | Bonatre | B66B 5/0081 187/401 |
| 2010/0200339 | A1* | 8/2010 | Henseler | B66B 5/005 187/401 |
| 2012/0280194 | A1* | 11/2012 | Stanojevic | A47C 1/121 256/26 |
| 2013/0092479 | A1* | 4/2013 | Bloch | B66B 5/0081 187/401 |
| 2014/0373360 | A1* | 12/2014 | Candler | E04G 21/3219 29/897.3 |

* cited by examiner

ELEVATOR

FIELD

The invention concerns an elevator having a car with a roof and a barrier arranged on at least one side of the roof to provide anti-fall safety protection.

BACKGROUND

Elevators feature cars, which, via means of support, for example in the form of supporting cables, or supporting belts, can be moved up and down in an elevator shaft by means of a drive unit. For particular situations such as, for example, maintenance tasks or inspections, it is necessary for persons to spend time on the elevator car roof. If the width of a gap between the car and the adjacent shaft wall is too large, barriers must be installed on the car roof to provide anti-fall safety protection.

As a general rule various items of electrical or electromechanical equipment and installations necessary for operation of the elevator system are arranged on or in the elevator car. These items of equipment and installations, hereinafter referred to as the "car electrical system", include, for example, the door controller, equipment for the evaluation of shaft information and for door monitoring, equipment for operating the system during maintenance, communications equipment, energy storage devices, car lighting or air conditioning systems. The car electrical system is supplied with power by way of cables, and at least elements of the car electrical system can communicate with one another by means of cables. Such cables are also located in the region of the car roof. In practice, the cables are often arranged on the car roof in a more or less exposed manner. The result is a disadvantageous organization of the cables and a safety risk in the form of "trip hazards" for the service personnel on the car roof. In principle, the cables could also be routed in a kind of double floor underneath the car roof, but this would be expensive and complex.

SUMMARY

It is therefore an object of the present invention to avoid the known disadvantages, and in particular to provide an elevator in which cables of the car electrical system can be arranged simply and in a space-saving manner on the car roof. In particular, the cables should not represent a risk for any persons located on the car roof.

The said objects are achieved with an elevator having a barrier to provide anti-fall safety protection arranged on at least one side of the roof of the car. The barrier has at least one bar, in particular a handrail formed from a bar and a toeboard, formed from a bar, which is fixed on an upper side of the car roof and arranged underneath the handrail. An additional intermediate bar can, if required, be arranged underneath the handrail as a third rail, preferably at mid height. By virtue of the fact that at least some of the cables of the car electrical system are or can be routed within at least one of the bars, the said cables can be organized simply and in a space-saving manner on the car roof. Any unintended encroachment on the cables, or possibly even stumbling over the cables can be ruled out for practical purposes. Since no complex additional measures are required the inventive solution also has advantages in terms of cost.

The bar, such as, for example, the toeboard, can feature a hollow profile forming a cavity for purposes of accommodating the cables. Alternatively the bar can feature an open, trough-shaped profile, which together with an upper side of the car roof forms a cavity for purposes of accommodating the cables. The trough-shaped profile can be configured as one part, or as multiple parts. The hollow profile could, for example, be a round tube. For the installation on the roof it can, however, be advantageous if the hollow profile is a rectangular profile. The trough-shaped profile can also have a rectangular shape. Needless to say, however, other shapes for the trough-shaped profile, or for the hollow profile, would also be conceivable. The arrangement is simple to manipulate and simple to assemble and disassemble.

For the housing of a plurality of cables it can be advantageous if the hollow profile or the trough-shaped profile is at least 8 cm high, and preferably is at least 10 cm high. In this manner a sufficiently large cavity ensues for purposes of accommodating the cables. The high toeboards can also serve as a stop for shoes and a kick plate for persons on the car roof. The hollow profile or the trough-shaped profile can, for example, consist of a metallic material. Needless to say, however, it would also be conceivable in principle to produce the toeboard from a plastic or another material.

It can be advantageous if the trough-shaped profile has at least one sidewall projecting from the car roof and an attachment section adjoining the sidewall, wherein the attachment section lies flat, or can lie flat, on the car roof. Particularly preferably the trough-shaped profile has sidewalls projecting at right angles from the car roof, wherein an attachment section adjoins each sidewall. Such a trough-shaped profile can thus be a top hat-profile or an omega-profile.

Furthermore it can be advantageous if the bar is constructed from at least two profiled parts that can be assembled together. Such a bar in at least two parts enables a simple introduction or removal into or out of the bar.

If the cable-routing bar is a toeboard, the toeboard can feature detent means, which prevent encroachment on the toeboard. In addition to the increase in safety, by virtue of the detent means it is possible to prevent the toeboard from being deformed or even destroyed as a result of encroachment.

The toeboard can, for example, comprise a freestanding detent section directed away from the car floor as the detent means. The detent section can be a vertical section on a sidewall of the trough-shaped profile, or adjoining the hollow profile.

DESCRIPTION OF THE DRAWINGS

Further individual features and advantages of the invention ensue from the following description of examples of embodiment and from the figures. Here.

DETAILED DESCRIPTION

Figure 1:
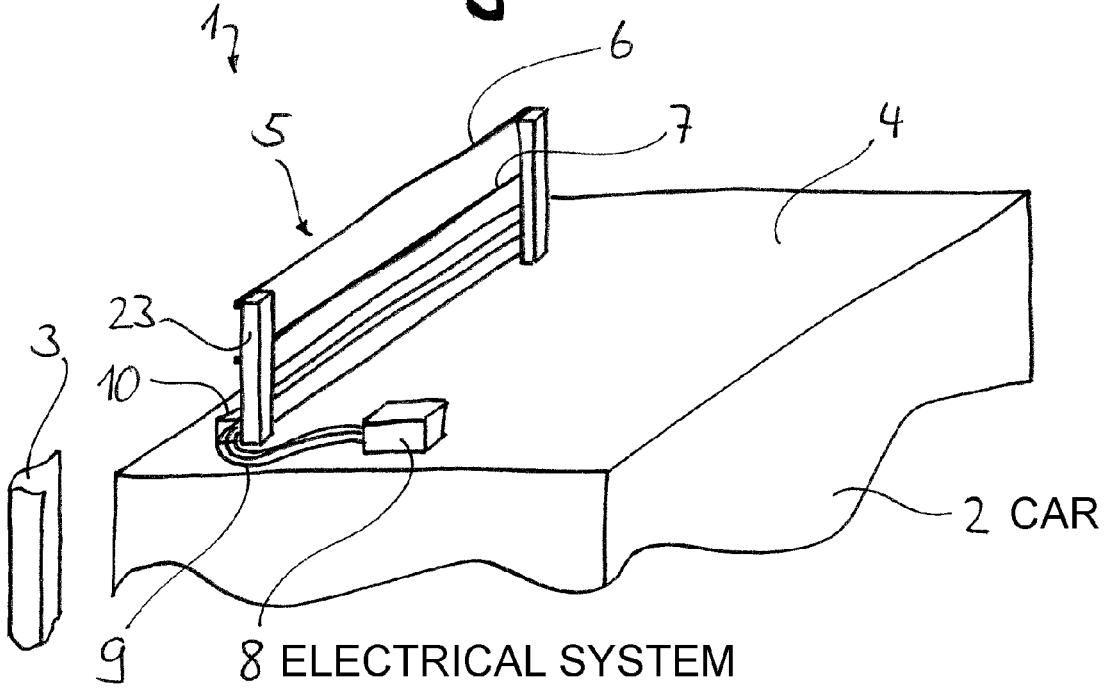
FIG. 1 shows a simplified illustration of an inventive elevator in perspective.

FIG. 1 shows an upper part of an elevator car 2 of an elevator 1. The elevator 1 features a car 2 that can be moved up and down for purposes of transporting persons or goods. The movement of the car 2 takes place, for example, by way of means of support (not shown here), which support the car, or on which the car is suspended. The means of support can, for example, be one or a plurality of supporting cables or supporting belts. An elevator shaft, in which the elevator car 2 can travel, is indicated in outline and designated as 3. The car 2 is closed off with respect to the head of the shaft by a car roof 4.

In the example of embodiment in accordance with FIG. 1 a barrier 5 is arranged on the car roof 4. Depending upon the car and the arrangement in the shaft the car 2 could, needless to say, also have a plurality of barriers, assigned in each case to a side of the car. The barrier 5 consists of an upper handrail 6, a central rail 7 arranged approximately at half height, and a toeboard 10 on the floor. Two vertical posts 23 are, for example, provided for purposes of supporting the rail 7 and the handrail 6. The car electrical system is symbolically illustrated in FIG. 1 by a box 8. Cables designated as 9 lead to or from this box. It can be seen that the cables 9 of the car electrical system 8 are routed within the toeboard 10. However, it would also be conceivable to route the cables through the handrail 6 formed from a bar, or through the intermediate rail 7 formed from a bar. Here the handrail 6 or the intermediate rail 7 can be produced from an appropriate hollow profile.

Figure 2:
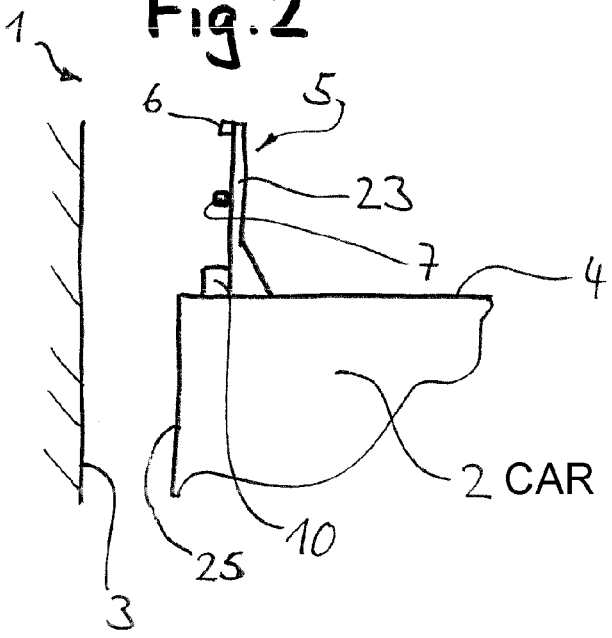
FIG. 2 shows a side view of the elevator in FIG. 1 with a barrier arranged on a car roof.

From the side view in FIG. 2, the principles of construction of a barrier 5 for purposes of arrangement on a car roof 4 can once again be seen. Between the shaft wall of the elevator roof 3 and the car sidewall 25 is located a comparatively large clearance volume, for which reason the barrier 5 is to be arranged in the region of the corresponding side of the car roof 4. As can clearly be seen from FIG. 2, the toeboard 10 has at its disposal a significantly larger volume compared with that of the handrail 6, and also compared with that of the central rail 7. By virtue of the larger cross-section it is possible to route a large number of cables (not shown in FIG. 2) within the toeboard 10. Design details for the configuration of cable-routing toeboards can be seen in the following FIGS. 3 to 5.

Figure 3:
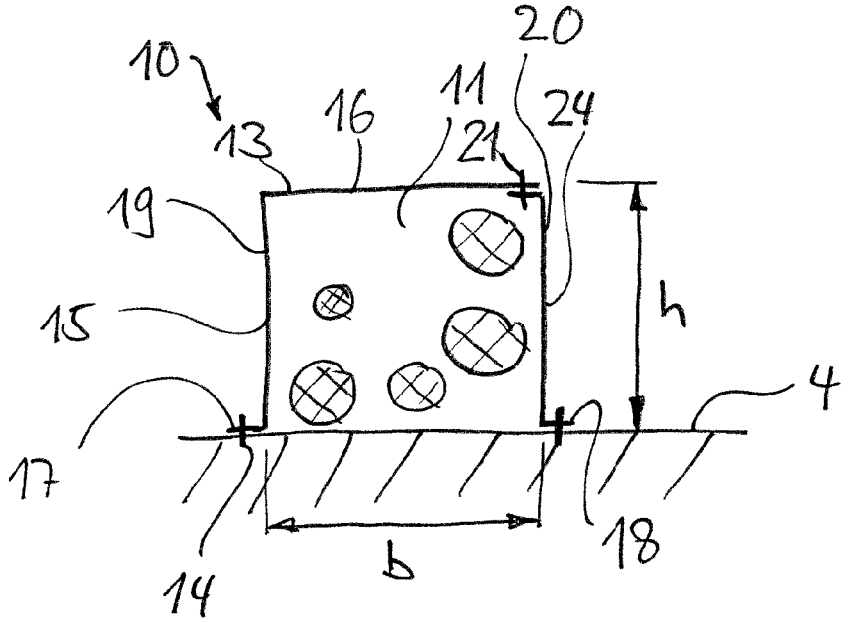
FIG. 3 shows an enlarged illustration of a toeboard of a barrier for an elevator in cross-section.

In FIG. 3 the toeboard 10 is formed from a two-part, trough-shaped profile 13. The profile 13 is in principle an open top hat-profile, which in the assembled state forms together with an upper side of the car roof 4 a cavity 11 for purposes of accommodating the cables 9. The toeboard 10 is composed of a first profile section 19 and a second profile section 20, which are connected with one another by means of (symbolically indicated) means of connection 21 (e.g. screws). Each profile section 19, 20, has a sidewall 15, 24 projecting vertically, that is to say, at right angles, from the car roof. Each sidewall 15, 24 is adjoined by an attachment section 17, 18 lying flat on the car roof 4. On the left-hand side the trough-shaped profile is connected by way of the attachment section 17 with the car roof, for example, by means of screws 14 or other means of attachment. On the opposite side, or right-hand side, that is to say, the trough-shaped profile 13 is connected by the attachment section 18 with the car roof 4, preferably with the same kind of means of attachment. A cover section adjoining the sidewall 15 at right angles is designated as 16; this closes off the cavity 11 in the upward direction. The dimensions of the toeboard 10 are designated as h and b. The height h of the toeboard is, for example, at least 8 cm, and preferably at least 10 cm. The width b can, for example, also be at least 8 cm, and preferably at least 10 cm. In this manner a sufficiently large cavity 11 can be created for purposes of accommodating the cables. The profile sections 19 and 20 can, for example, be simply produced from a metal sheet. Needless to say it would, however, also be conceivable in principle to produce the profile for the toeboard 10 from a plastic or another material.

Figure 4:
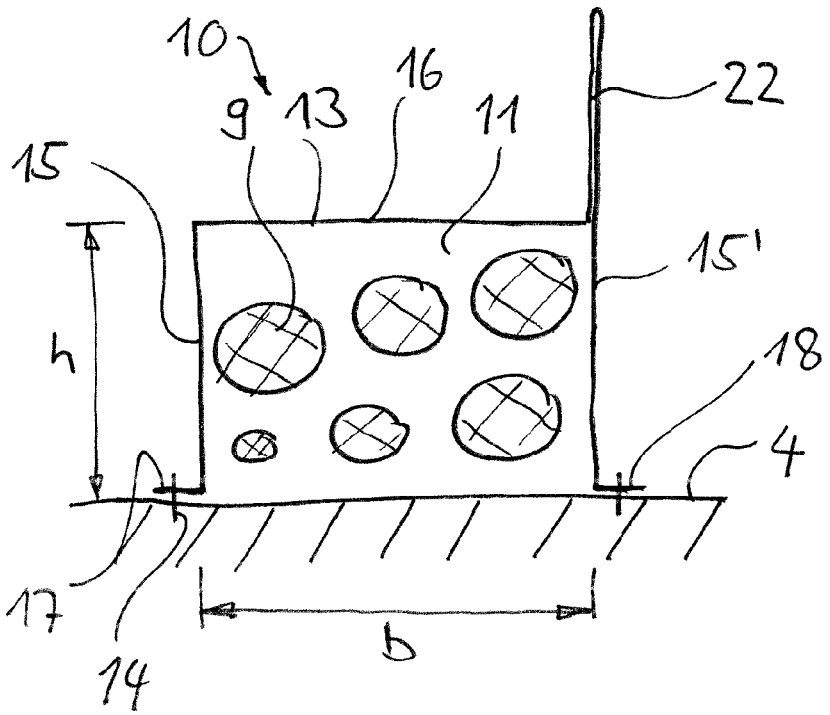
FIG. 4 shows an alternative toeboard.

The toeboard 10 in accordance with FIG. 4 has essentially the same basic shape as the toeboard in the preceding example of embodiment. Here, however, the toeboard 10 is formed from a one-part, trough-shaped profile 13. The rectangular top hat-profile 13 has two sidewalls 15 and 15' located opposite one another. A detent section 22, which adjoins the inner sidewall 15', is designed to prevent encroachment on the toeboard 10. By the said inner sidewall 15' is meant the wall of the toeboard facing the person that may be located on the car roof. The detent section 22 extending vertically upwards can extend beyond the cover section 16 by several centimeters (advantageously at least 5 cm).

Figure 5:
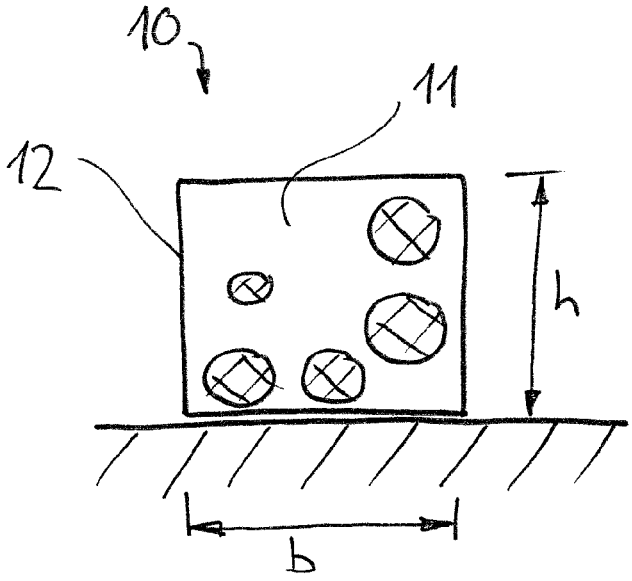
FIG. 5 shows a further variant of a toeboard for a barrier for an elevator.

Instead of the above-described trough-shaped hollow profiles the toeboard could also be formed from other hollow profiles. Such a configuration is shown in FIG. 5. The toeboard 19 is formed from a rectangular hollow profile 12. The said hollow profile 12 can, for example, be a rectangular tube of aluminum or possibly even of steel. Needless to say, however, top hat-profiles made from plastic would also be conceivable.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator with a car having a car roof, comprising:

a barrier arranged on at least one side of the car roof to provide anti-fall safety protection; and the barrier having at least one bar through which electrical cables are routed.

2. The elevator in accordance with claim 1 wherein the at least bar is a handrail, an intermediate rail or a toeboard.

3. The elevator in accordance with claim 1 wherein the at least one bar has a hollow profile forming a cavity accommodating the cables, or an open, trough-shaped profile that together with the car roof forms the cavity for accommodating the cables.

4. The elevator in accordance with claim 3 wherein the hollow profile or the trough-shaped profile is at least 8 cm high.

5. The elevator in accordance with claim 3 wherein the trough-shaped profile is attached to the car roof by attachment means that are detachable.

6. The elevator in accordance with claim 3 wherein the trough-shaped profile has at least one sidewall projecting from the car roof, and at least one attachment section adjoining the at least one sidewall, wherein the at least one attachment section lies flat on the car roof.

7. The elevator in accordance with claim 3 wherein the trough-shaped profile has sidewalls projecting at right angles from the car roof, wherein a separate attachment section adjoins each of the sidewalls.

8. The elevator in accordance with claim 1 wherein the at least one bar formed from at least two profile sections assembled together.

9. The elevator in accordance with claim 1 wherein the at least one bar is a toeboard having a detent section for preventing encroachment on the toeboard.

10. The elevator in accordance with claim 9 wherein the detent section extends away from the car roof beyond an upper cover section of the toeboard.

* * * * *